US010058138B2

(12) United States Patent
Alex

(10) Patent No.: US 10,058,138 B2
(45) **Date of Patent: *Aug. 28, 2018**

(54) HAIR BAND WITH HAIR CARRYING STRIPS WITHOUT LOOPED HAIR ENDS

(71) Applicant: Gunter Alex, Deutschland (DE)

(72) Inventor: Gunter Alex, Deutschland (DE)

( * ) Notice: Subject to any disclaimer, the term of this patent is extended or adjusted under 35 U.S.C. 154(b) by 2 days.

This patent is subject to a terminal disclaimer.

(21) Appl. No.: 15/132,756

(22) Filed: Apr. 19, 2016

(65) Prior Publication Data

US 2017/0208885 A1 Jul. 27, 2017

Related U.S. Application Data

(63) Continuation-in-part of application No. 15/006,218, filed on Jan. 26, 2016.

(51) Int. Cl.
*A41G 5/00* (2006.01)
*A45D 8/36* (2006.01)

(52) U.S. Cl.
CPC ..... *A41G 5/0073* (2013.01); *A41G 5/0093* (2013.01); *A45D 8/36* (2013.01)

(58) Field of Classification Search
CPC ..... A41G 5/00; A41G 5/004; A41G 5/0073; A41G 5/0046; A45D 8/36; A45D 2008/004
See application file for complete search history.

(56) References Cited

U.S. PATENT DOCUMENTS 3,280,826 A 10/1966 Jenkins
3,716,065 A 2/1973 Finamore
3,848,612 A 11/1974 Kohler
4,456,019 A 6/1984 Finamore
4,599,749 A 7/1986 Childs et al.
5,213,871 A 5/1993 VanBortel et al.
5,281,288 A 1/1994 Murray et al.
5,722,434 A 3/1998 Walker
5,855,211 A 1/1999 Nelson
5,881,737 A 3/1999 Nelson
(Continued)

FOREIGN PATENT DOCUMENTS

DE 365 353 12/1922
DE 876 681 5/1953
(Continued)

OTHER PUBLICATIONS

PCT/EP2017/051564 International Searching Authority Report, dated Jan. 25, 2017.

*Primary Examiner* — Rachel Steitz
(74) *Attorney, Agent, or Firm* — Robert C. Kain, Jr.

(57) ABSTRACT

A hair band with a lateral and longitudinal stretchable foundation carries a plurality of no-looped-hair hairband strips in a brick layered pattern thereby permitting the hairband strips to move, up, down and laterally with the expandable foundation. The foundation, with an elastically attached filament, encircles the user's head. The strips have hairs disposed in parallel on a tape substrate and adhered thereto by a matrix of hygroscopic sealant, glass silk and polyurethane atop to adhere the hairs to the tape substrate. The parallel mounted hairs avoid cuticular scale interference between adjacent hairs which fall beyond the head of the user wearing the hair band.

5 Claims, 9 Drawing Sheets

(56) References Cited

U.S. PATENT DOCUMENTS

| | | | | |
|---|---|---|---|---|
| 6,267,118 | B1 | 7/2001 | Ito et al. | |
| 6,405,736 | B2 | 6/2002 | Townsend | |
| D465,615 | S | 11/2002 | Brunelle | |
| D495,449 | S | 8/2004 | Kellmann | |
| 6,830,054 | B1 | 12/2004 | Ross-Kuehn | |
| 7,201,171 | B2 | 4/2007 | Sthair | |
| 7,610,921 | B2 | 11/2009 | Gold | |
| 7,753,057 | B2 | 7/2010 | Kallabat et al. | |
| 8,161,980 | B2 | 4/2012 | Inoue et al. | |
| 2001/0037813 | A1 | 11/2001 | Ra | |
| 2002/0100489 | A1 | 8/2002 | Minnelli | |
| 2002/0185146 | A1 | 12/2002 | Gold | |
| 2003/0116170 | A1 | 6/2003 | Nicot et al. | |
| 2004/0129285 | A1 | 7/2004 | Frazier | |
| 2004/0225314 | A1 | 11/2004 | Fukuyama | |
| 2005/0247324 | A1 | 11/2005 | Nicot et al. | |
| 2005/0252517 | A1 | 11/2005 | Salinas | |
| 2005/0268928 | A1 | 12/2005 | Lane | |
| 2006/0144413 | A1 | 7/2006 | Yoneda et al. | |
| 2006/0169296 | A1 | 8/2006 | Gill et al. | |
| 2006/0174905 | A1 | 8/2006 | Bias | |
| 2007/0034221 | A1* | 2/2007 | Chung | A41G 3/0016 132/53 |
| 2007/0125399 | A1 | 6/2007 | Guliker | |
| 2007/0157944 | A1 | 7/2007 | Catron et al. | |
| 2009/0235948 | A1 | 9/2009 | Zephyr et al. | |
| 2009/0260649 | A1 | 10/2009 | Sakurai et al. | |
| 2010/0043814 | A1 | 2/2010 | Hamano | |
| 2010/0154812 | A1 | 6/2010 | Westerman Holstijn | |
| 2010/0170523 | A1 | 7/2010 | Depalma | |
| 2010/0170527 | A1 | 7/2010 | Toba | |
| 2010/0192965 | A1 | 8/2010 | Kang | |
| 2011/0017224 | A1 | 1/2011 | Freelove | |
| 2011/0094530 | A1 | 4/2011 | Sedillo-Beadell | |
| 2015/0013710 | A1* | 1/2015 | Buzaglo | A41G 5/0093 132/201 |
| 2015/0068546 | A1* | 3/2015 | Russell | A41G 3/0058 132/201 |

FOREIGN PATENT DOCUMENTS

| | | |
|---|---|---|
| DE | 20 2005 010 845 U1 | 11/2005 |
| EP | 1 642 510 | 4/2006 |
| FR | 1 401 444 | 4/1965 |
| GB | 2 456 655 | 7/2009 |
| WO | WO 2011/120599 | 10/2011 |

* cited by examiner

HAIR BAND WITH HAIR CARRYING STRIPS WITHOUT LOOPED HAIR ENDS

This is a continuation-in-part of U.S. patent application Ser. No. 15/006,218, filed Jan. 26, 2016, now pending, the contents of which is incorporate herein by reference thereto.

The present relates to a hair band that carries either hair extensions or portions of a wig which is worn by a user. The hair band has hair-carrying strips mounted in a bricklayered manner on a net foundation and hair on the no-looped-hair hairband strips has hair mounted thereon in a substantially parallel manner and all cuticular hair scales lay in the same direction to avoid cuticular scale interference between adjacent hairs.

Several different types of hair bands have been proposed in prior art systems. U.S. Patent Publication 2002/0100489 to Mannelli discloses a head band with natural hair having an elastic member which establishes a tension fit of the hair band about the head of the user. U.S. Patent Publication No. 2004/0129285 to Frazier discloses a hair extension attachment also with elastic bands. U.S. Patent Publication 2006/0174905 to Bias discloses a hair piece with a portion of the head band being elastic. U.S. Pat. No. 4,599,749 to Childs discloses a cap which carries hair and having an elastic draw string which creates folds in the back of the cap and hair extending outboard beyond the folds. U.S. Pat. No. 6,830,054 to Ross-Kuehn discloses a plurality of hair wefts which are attached to an elastic band which alternately is adopted to be worn on the head of a user. U.S. Pat. No. 8,161,980 to Inoue discloses a hair piece with an elastic band portion connected to a foundation wherein the foundation carries a plurality of hairs.

U.S. Patent Publication No. 2003/0116170 to Nicot discloses a foundation which is stretchable both laterally and longitudinally and carries a plurality of hairs. The Nicot patent disclosure also discusses a plurality of hair wefts which are mounted on the foundation. The Frazier '285 publication also discusses hair wefts. U.S. Pat. No. 3,280,826 to Jenkins discloses hair wefts attached to an elongated foundation.

Published German petit patent DE 20-2005-010845, published Nov. 17, 2005, discloses a hairband element consisting primarily of double-sided adhesive tape which carries, throughout the entire rectangular hairband element, hairs which are substantially adhered in a parallel manner on the double-sided tape (the parallel hairs are perpendicular to the longitudinal span of the rectangular hair band element). The back side or rear of the hairband element, adapted to be positioned inboard near the user's head, initially includes a removable tape cover (which is removed by the user prior to attaching the hairband element and parallel falling hairs to the user's head). The cross-sectional composition of the hairband element includes a removable tape cover on the back side of the hairband element and an adhesive layer, which is associated with the double sided tape substrate and an opposing adhesive layer. Hairs are laid in a parallel on the outboard facing adhesive layer and a sealant is applied to the parallel hair layer. If human hair is utilized, the sealant is hygroscopic such that the sealant absorbs and releases water i a similar manner to human hair. The outermost or front face of the hairband element has a matte finish cover over the sealant.

OBJECTS OF THE INVENTION

It is an object of the present invention to provide a hair band which is extendable or stretchable both laterally (vertically) and longitudinally (lengthwise) and carries a plurality of hair wefts mounted on the foundation in a bricklayered pattern.

It is another object of the present invention to provide a filament which is attached via elastic members to the foundation which filament, elastic members, and foundation establish a tension fit on the head of the user (the elastic and foundation being stretchable).

It is a further object of the present invention to have the hair from the hair wefts covering intermediate spaces between the bricklayered hair weft pattern on the foundation. Stated otherwise, longitudinally aligned, but spaced apart, hair wefts define longitudinal gaps between adjacent longitudinal hair wefts. The laterally upper longitudinal run of hair wefts are transposed longitudinally away from the lower hair weft pattern such that an upper hair weft is laterally aligned with the lower longitudinal gap between the adjacent lower hair wefts. The result is a bricklayered pattern of hair wefts wherein upper hair weft pattern has hair which falls over the longitudinal gaps in the lower hair weft pattern. Coverage is provided by this bricklayered pattern of hair wefts mounted on the foundation band. Additionally, the bricklayered hair wefts move and stretch and wrinkle with the foundation band dependent upon the user's activity.\

It is an object of the present invention to provide a hairband strip element which retains the hairs in a substantially flat and substantially parallel manner on a generally rectangular hairband strip as a replacement to the looped over hairs retained on a hair weft.

It is a further object of the present invention to provide a hairband strip element which is mounted on a stretchable netted foundation in a bricklayer manner to facilitate the free movement of hair extensions depending from the primary hair band system commensurate with the movement of the user's natural hair.

SUMMARY OF THE INVENTION

The hair band system, which is adapted to be worn on the head of a user, includes an elongated stretchable foundation band which is both laterally and longitudinally expandable. A plurality of hair wefts each carrying a plurality of hairs. These hairs are adapted to fall beyond the head of the user when the hair band is in use. The hair wefts are attached to the foundation in a bricklayered pattern which permits the hair wefts to move both laterally and longitudinally when the foundation expands or contracts or wrinkles. A filament is attached to the foundation such that both the filament and the foundation extend about the head of the user when in use. At least one elastic member is attached between the foundation and the filament. Typically, the filament is attached to the foundation band at both filament ends by an elastic element at each end. When the hair band system is worn by the user, the elastic and the foundation establishes a tension fit about the head of the user. Preferably, two elastic members are used, one at either end of said filament. Respective cloth tunnels on the foundation cover portions of these elastic elements, particularly at the respective interfaces between the elastic members and the foundation. This tunnel or closed channel reduces irritation of the user's scalp. When not in a tension fit about the head of the user, the elastic members or elements extend outboard of the tunnels. In this manner, the elastic ends are exposed.

The foundation has an upper edge and a lower edge and an intermediate segment. A first plurality of hair wefts are mounted to the upper edge of the foundation in a first spaced apart pattern. A second plurality of hair wefts are mounted to the foundation laterally (vertically) below the upper hair wefts in a second spaced apart longitudinally aligned pattern on the intermediate segment of the foundation. A third plurality of hair wefts are mounted to the lower edge of the foundation in a third spaced apart pattern. In this manner, respective intermediate spaces of the first, second and third spaced apart patterns are covered by hairs falling there over due to the brick layered pattern. In a preferred embodiment, ten (10) longitudinal runs of hair wefts are mounted on the stretchable foundation, each longitudinal run covering the lower longitudinal gaps of the lower longitudinal run of hair wefts.

Another embodiment of the present invention replaces the hair wefts with no-looped-hair hairband strips. The no-looped-hair hairband strips or "NLH hairband strips" replace hair wefts 22 which wefts carry looped-over hairs. Hairs are arranged or disposed in a substantially parallel manner on double sided tape (the tape substrate) and are further adhered to the substrate by hygroscopic sealant. The hairs are further embedded in a glass silk net layer with one or more applications of polyurethane. The sealant, the glass silk and the polyurethane layers over the hair forms a matrix about the hairs to adhere the hairs to the tape substrate. Human hair is typically 40-100 microns thick (diameter) and glass silk fiber is about 5 to 10 microns [μm] in diameter, therefore the considerably smaller sized glass silk fibers fall between the much larger hair and the sealant and polyurethane form an adhering matrix on tape substrate 51. The NLH hairband strips replace the hair wefts and are mounted (sown) onto the foundation netting of the primary hair band in a bricklayered manner.

BRIEF DESCRIPTION OF THE DRAWINGS

Further objects and advantages of the present invention can be found in the detailed description of the preferred embodiments when taken in conjunction with the accompanying drawings wherein.

DETAILED DESCRIPTION OF THE PREFERRED EMBODIMENTS

The present invention relates to a hair band for hair extensions or partial wigs worn by a user. The figures, which are discussed concurrently herein, have similar numerals designating similar items.

Figure 1:
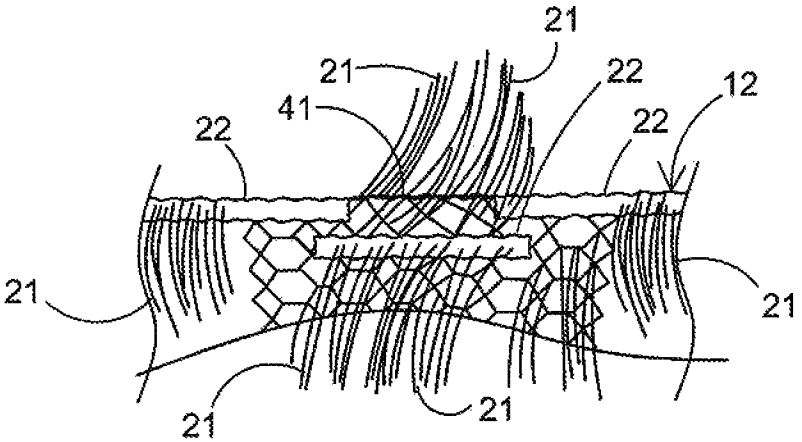
FIG. 1 diagrammatically illustrates a portion of the foundation band, a few hair wefts mounted on the foundation band, and diagrammatically illustrates some of the hairs attached to the hair wefts in the foundation and some of the hairs attached to the foundation band itself.
Figure 6:
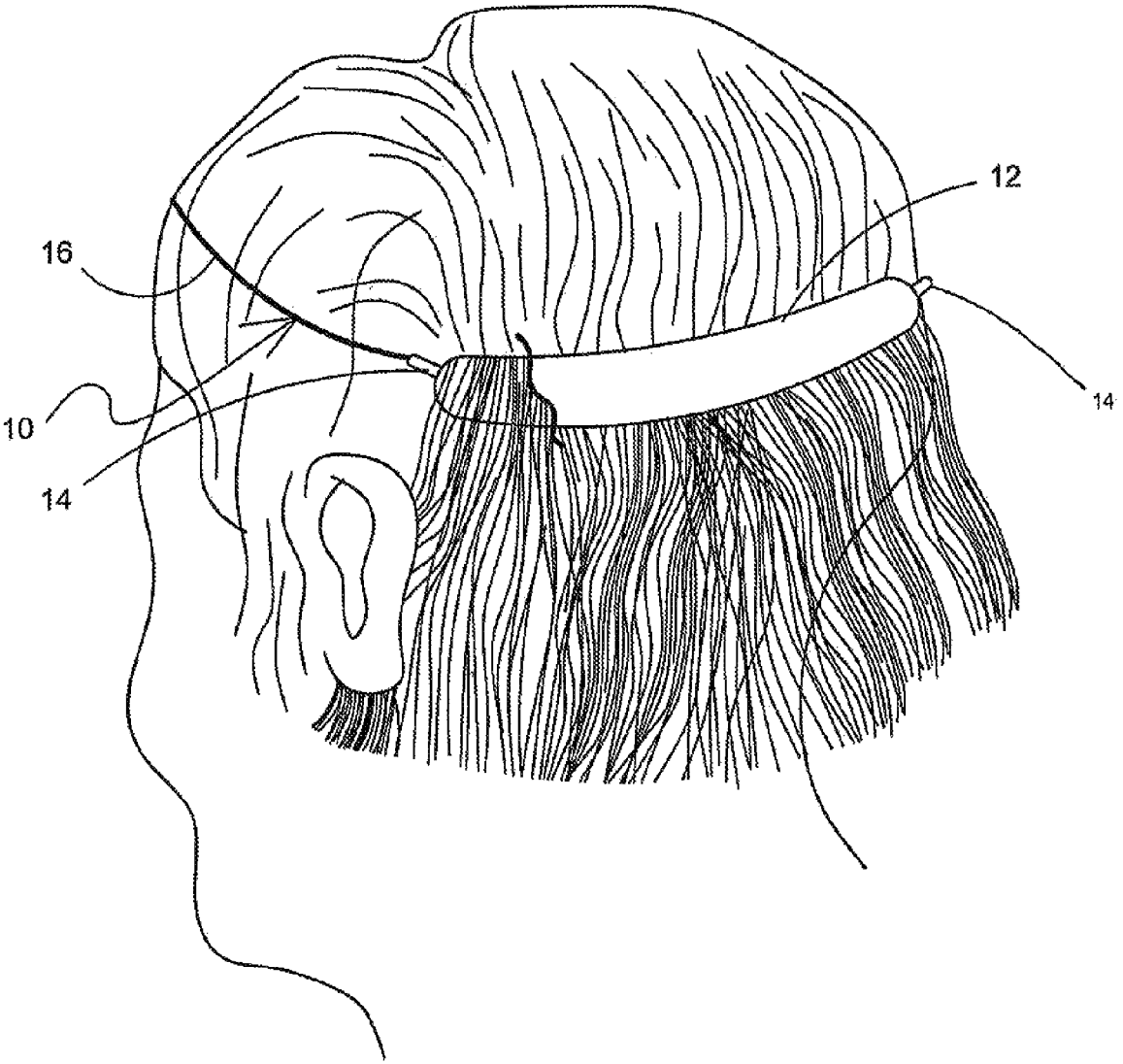
FIG. 6 diagrammatically illustrates the hair band system worn by the user.

FIG. 1 shows hair band 12, foundation band 20 and a plurality of hair wefts 22 with a large number of hairs 21 attached to the foundation 20 and attached to the hair wefts 22. FIG. 6 shows that hair band system 10 includes an elongated foundation band 12, a filament 16 and an elastic member 14. The hair band system 10 has a plurality of hair which falls beyond the head of the user. Only a small portion of the hairs are shown in all the figures.

Figure 5:
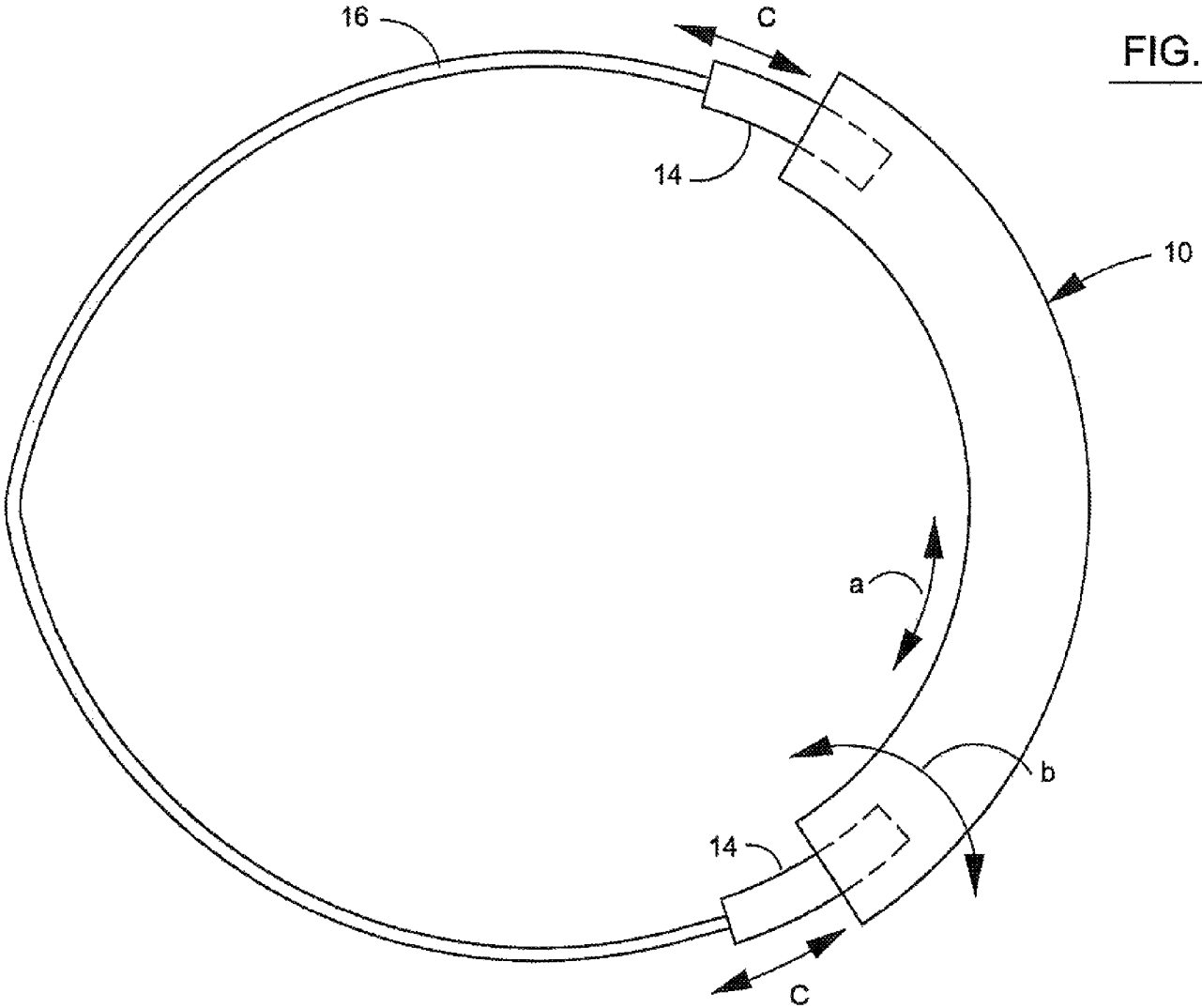
FIG. 5 diagrammatically illustrates the hair band system with the foundation band, the elastic members and the filament.

In a like manner, FIG. 1 shows only a portion of foundation band 20 of hair band system 10 (see system 10, FIGS. 5, 6). The top edge 41 of foundation 20 has a plurality of longitudinally spaced apart hair wefts 22. Each hair weft has a plurality of hairs 21 which are attached to the weft and which fall beyond the head of the user. See FIG. 6 which shows only a partial view of the hair falling off the hair band system 10.

In addition in FIG. 1, a plurality of hairs 21 are attached to top edge 41 of foundation band 20. These are hand-tied to the foundation. The longitudinal space or gap between the top left hand hair weft 22 and the top right hand hair weft 22 is longitudinally covered by a lower intermediate hair weft 22 mounted on an intermediate segment of foundation 20. A plurality of hairs 21 extend from the intermediate hair weft 22.

In addition, a plurality of hairs 21 are attached to top edge 41 of foundation 20. Further, another plurality of hairs 21 are attached at intermediate lower or lateral positions on foundation 20. In this manner, the hairs attached to the top edge 41 of foundation 20 fall down and cover the open longitudinal space and the resulting lateral space between edge 41 and the lower intermediate hair weft 22 and the intermediate foundation segment between upper edge 41 and lower edge 43. Lower edge 43 is shown in FIG. 3.

Figure 2:
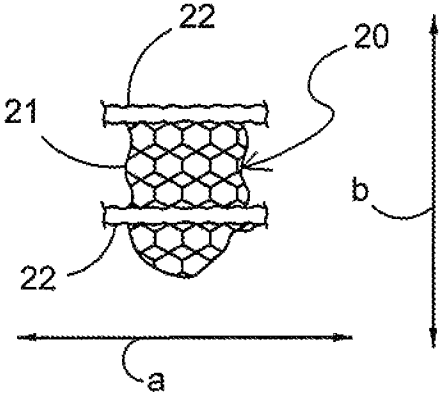
FIG. 2 diagrammatically illustrates a portion of the stretchable foundation and the lateral and longitudinal expansion-contraction and wrinkling aspect of the foundation band.

FIG. 2. diagrammatically shows a partial, detailed view of the expandable or stretchable foundation band 12 and an upper hair weft 22 and a lower hair weft 22 with foundation cells 21 therebetween. Cells 21 form the foundation band 20. The foundation is structured such that it expands and contracts longitudinally as shown by dimension a and laterally up and down as shown by dimension b.

Figure 3:
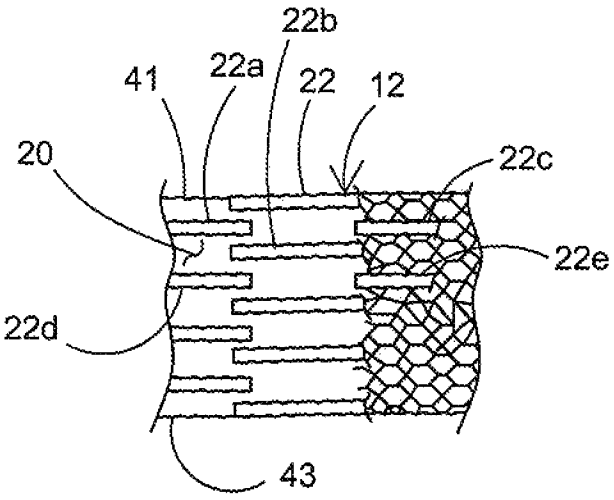
FIG. 3 diagrammatically illustrates the brick layer pattern of mounting the hair wefts on the foundation.

FIG. 3 diagrammatically illustrates the brick layered mounting pattern of the hair wefts 22 on foundation 20. Between the upper edge 41 of foundation band 20 and lower edge 43 of foundation 20, a plurality of hair wefts are mounted on the foundation. Only a portion of the foundation netting or foundation cells is shown in FIGS. 1, 2 and 3.

The brick layered hair weft pattern is established between laterally spaced apart longitudinal runs of hair wefts. Hair weft 22 in FIG. 3 is mounted on the top edge 41 of the foundation Immediately laterally below is a longitudinally displaced, left side hair weft 22*a* and a longitudinally displaced, right side hair weft 22*c*. The intermediate longitudinal space between intermediate longitudinally spaced apart hair weft 22*a*, 22*c* is covered by hairs which extend from the upper hair weft 22. Laterally below upper hair weft 22 is a fourth hair weft 22*b*. Hair weft 22*b* spans or covers a longitudinal space between left and right hair weft 22*d*, 22*e*. Laterally below hair weft 22*b* is longitudinally displaced left hair weft 22*d* and right hair weft 22*e*. The longitudinal space between hair wefts 22*d*, 22*e* is covered by hair from the upper centrally located hair weft 22*b*. In this manner, the plurality of hair wefts establish a brick layered pattern on foundation 22. This is one of the several important features of the present invention because this brick layered pattern permits the foundation to expand and contract and adjust for winkles both in a longitudinal manner (left and right in connection with the head band system 10 (FIG. 6)) as well as laterally, that is up and down, in the direction b (FIG. 2).

Figure 4:
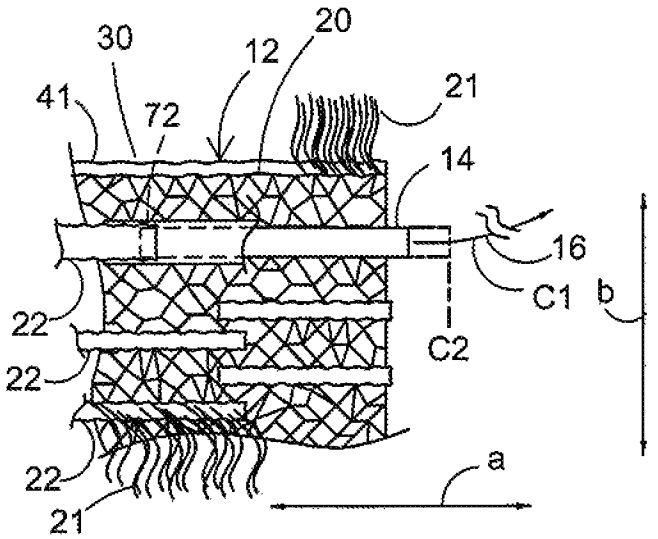
FIG. 4 diagrammatically illustrates the elastic member attached between the filament and the foundation band.

FIG. 4 diagrammatically shows a filament 16 attached at one end to elastic member 14. Elastic member 14 has an inboard end 72 that is attached to foundation 20. Elastic 14 is mounted intermediate the filament 16 and the foundation band 20. For a higher degree of support and attachment, hair weft 22 is attached to both the elastic end 72 and the foundation 20. Elastic 14 is disposed in a cloth channel or a tunnel 30. In FIG. 4, only a portion of the tunnel is shown in a broken-away view. Hairs 21 are attached to the upper edge 41 of the foundation 20. As partly shown, the lower hair weft carries a number of hairs 21.

When the hair band system is worn by the user (see FIG. 6), the elastic 14 extends outboard of tunnel 30 and filament 16 extends to extended position C2. When the elastic is at rest and not in a tension mode, only a portion of the elastic 14 extends outboard of tunnel 30. The extension mode of elastic 14 is shown in FIG. 4 as a dashed dot dashed line C2. The rest or non-tension mode is also shown as a solid line as C1. As discussed earlier, foundation 20 can move longitudinally in the direction a and can also move laterally in the direction b.

FIG. 5 diagrammatically illustrates a plain view of hair band system 10. The hair band system includes an elongated generally rectangular foundation band 12 which carries a plurality of hairs (not shown). The hair band system includes elastic elements 14 which are attached to the ends of filament 16 thereby permitting the filament to be in a tension mode about the head of the user. Longitudinal expansion is permitted in direction a and lateral expansion and contraction is permitted in direction b. The tension or rest position is shown by arrows C1, C2 in FIG. 4 and direction C in FIG. 5.

FIG. 6 shows only a portion of the hairs covering band element 12 of hair band system 10.

Figure 7:
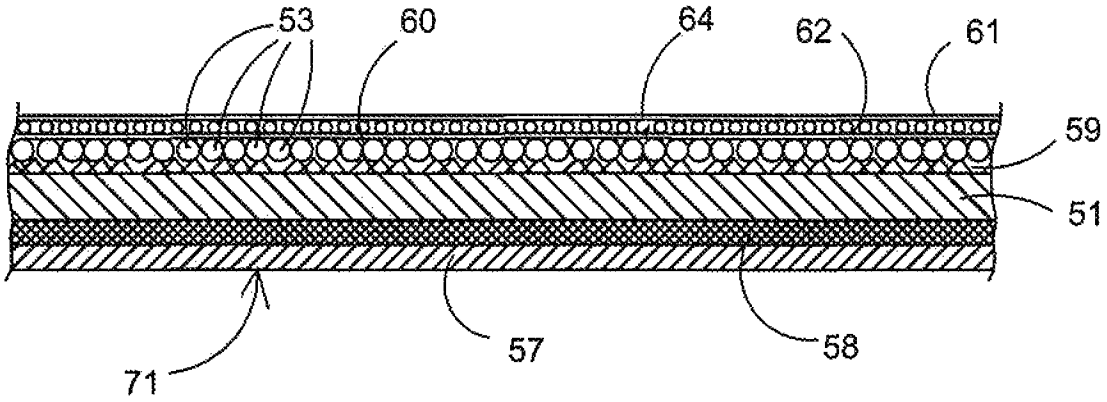
FIG. 7 diagrammatical illustrates a cross-section of a hairband strip which replaces the hair weft 22 in the primary hair band system 12 shown in FIGS. 1-6. These no-looped-hair hairband strips in FIG. 7 are used in the primary hair band system shown in FIG. 6 as the secondary hair-carrying strips (bricklayered on the net foundation) which strips do not include looped hair or looped hair ends.
Figure 9:
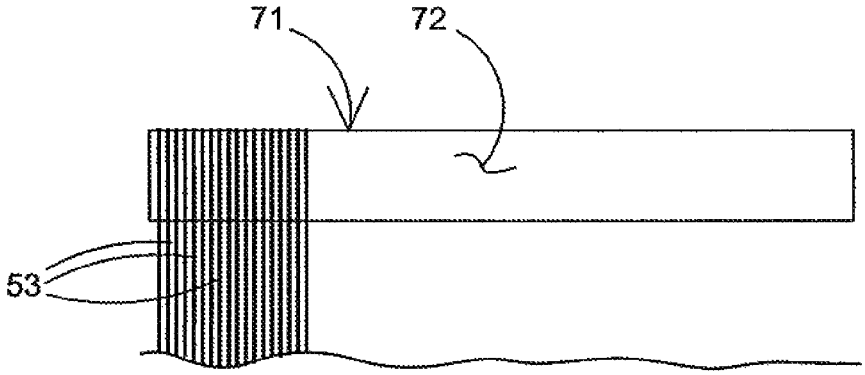
FIGS. 9 and 10 diagrammatical, respectively illustrate the backside and the front side of the no-looped-hair hairband strips which replace replaces the secondary hair wefts 22 in the primary hair band system 12 shown in FIGS. 1 and 6.
Figure 10:
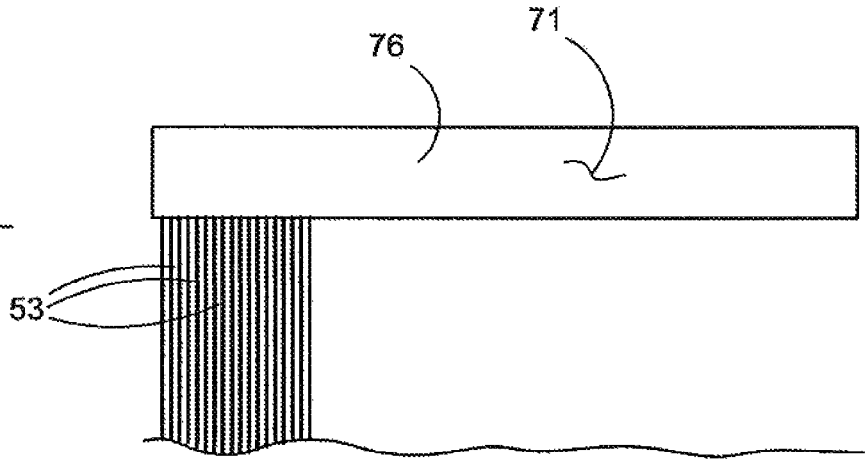

FIG. 7 shows a cross-section of a no-looped-hair hairband strip. FIGS. 9 and 10 diagrammatical, respectively illustrate the backside and the front side of the no-looped-hair hairband strips of FIG. 7 which no-looped-hair hairband strips replace the secondary hair wefts 22 in the primary hair band system 12 shown in FIGS. 1 and 6. This is another embodiment of the present invention. FIGS. 7, 9 and 10 are discussed concurrently herein. The no-looped-hair hairband strips or "NLH hairband strips" replace hair wefts 22 which wefts carry looped-over hairs.

Figure 8:
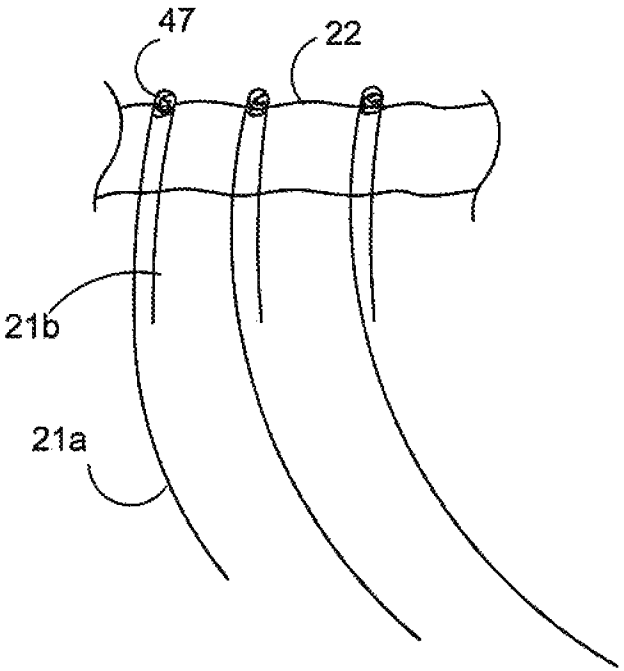
FIG.8 Prior Art
FIG. 8 diagrammatical illustrates the prior art hair weft which has looped-over hairs wherein the hairs are tied at a midsection to the hair weft base element.

FIG. 8 diagrammatically shows the prior art looped-over hair on prior art weft 22.

It is known that hair as cuticular scales on each hair strand. These cuticular scales always point from the proximal or root end of the hair to the distal or tip end of the hair. As a result, when hair segment 21*a* rubs against hair segment 21*b* (in FIG. 7), due to the looped over knot at hair midsection 47 on hair weft 22, adjacent hair strands have opposing cuticular scales which cause the adjacent hair strands to bunch up causing unwanted wrinkles or waves in the downwardly flowing hairs from each hair weft. These unwanted wrinkles or waves in the downwardly flowing hairs (see FIG. 6) are unsightly. The same cuticular scale interference occurs with multiple hair strands that knotted on the hair weft 22 next to each other, that is, different hair strands may have opposing cuticular scales rub against each other causing unwanted ripples or waves in the hair extension is compared with natural hair falling downward from the user's head.

The NLH hairband strips shown in FIGS. 7, 9 and 10 overcome the issues discussed above in connection with the use of hair wefts 22 in the primary hair band system 10 in FIGS. 5 and 6. As shown in FIGS. 9 and 10 (discussed in detail below), all the hair strand are laid out on the NLH hairband in a substantially parallel manner on the tape substrate. Therefore, all the cuticular scales lay in the same direction and do not interfere with the scales on the adjacent hair strands.

FIGS. 7, 9 and 10 are discussed concurrently herein. The primary supporting structural element for the NLH hairband 71 is provided by the double face adhesive tape substrate 51 (FIG. 7). The back or the rear face of NLH hairband 71 is shown in FIG. 9 as back surface 52. The back surface is inboard near the skull of the user. Hairs 53 fall in a substantially parallel manner off of hairband strip 71 in FIGS. 9 and 10 and are generally perpendicular to the longitudinal length of the generally rectangular NLH hairband 71 shown in FIGS. 9 and 10. FIG. 10 shows the front face 76 of the NLH hairband strip 71.

Double sided adhesive tape 51 and FIG. 7 shows adhesive layer 58 on its face, which is covered by removable cover layer 57. Cover 57 is removed prior to use. The tape substrate 51 has an opposing adhesive layer 59. On adhesive layer 59, hairs 53 are arranged or disposed in a substantially parallel manner. Hairs 53 also are mounted onto tape substrate 51 by a sealant 60. For human or natural hair (not synthetic hair) the hygroscopic characteristics of hairs 53 change based upon humidity and water content. Therefore, any material dimensional change of hairs 53 (a change in any or all three dimensions) relative to environmental humidity change is accounted for with the hygroscopic sealant 60. The sealant has similar hygroscopic characteristics as does natural hair. Changes in hair dimensions, which occur without sealant 10, regularly result in the hairs losing their adhesive grip on tape substrate 51, given the usual fluctuations of relative or environmental humidity.

In addition to adhesive layer 59 and sealant 60, in order to adhere the hairs to adhesive tape 51, the hairs are further embedded in a glass silk net layer 64 with one or more applications of polyurethane. In one embodiment, the glass silk net layer 64 and polyurethane layer 62 forms a matrix about hairs 53 to adhere the hairs to the tape substrate 51. Although the cross-sectional illustration of FIG. 7 shows distinct layers of hair 53, polyurethane layer 62 and glass silk layer 64, in fact a matrix of intermingled materials (hair and glass silk) and adhering material (sealant and polyurethane) is disposed on the backside of tape substrate 51. Therefore, the NLH hairband strip does not have the defined layers 53, 59, 60, 64 and 62 as illustrated in FIG. 7.

Human hair is typically 40-100 microns thick (diameter) and glass silk is fiber glass in the form of continuous filaments used in textiles. Glass silk is a product consisting of several hundred strands of indefinite length made of fibers 5 to 10 microns [μm] in diameter. Therefore, the considerably smaller sized glass silk fibers fall between the much larger hair and the sealant and polyurethane form an adhering matrix on tape substrate 51.

A matte finish cover 61 is finishes the NLH hairband strip 71. The cover 71 is disposed on the front side of the hair-sealant-glass silk-polyurethane matrix.

Referring to FIGS. 1, 3 and 4, the NLH hairband strips 71 replace hair wefts 22 mounted on net foundation 20. The hair wefts 22 are sown onto the foundation 20. The NLH hairband strips 71 are similarly sown onto the net foundation 20 in a bricklayered manner. By using the NLH hairband strips 71, which hairband strips 71 carry the bulk of the extension hair (see FIG. 6), the hair depending from the primary hair band 10: (a) lies flatter than the hair from hair wefts 22 (because the hair from the NLH hairband strips 71 falls flat, falls parallel to each hair strand and is not looped or tied to a substrate) and (b) does not suffer loop-over created cuticular scale interference (and therefore does not create unsightly waves or wrinkles).

The claims appended hereto are meant to cover modifications and changes within the scope and spirit of the present invention.

What is claimed is:

1. A hair band adapted to be worn about the head of a user comprising:

an elongated stretchable foundation which is both laterally and longitudinally expandable;

a plurality of no-looped-hair hairband strips attached to said foundation in a bricklayered pattern thereby permitting said hair wefts to move both laterally and longitudinally with the foundation expansion;

each hairband strip having embedded in a glass silk-polyurethane matrix a plurality of substantially parallel hairs with cuticular scales laying in the same direction to avoid cuticular scale interference between adjacent hairs which fall beyond the head of the user wearing the hair band;

a filament attached to said foundation such that both said filament and said foundation are adapted to extend about the head of the user; and two elastic members, one at either end of said filament and each elastic member connected between said filament and said foundation; and respective cloth tunnels for part of said elastic elements at the respective interfaces between said elastic members and said foundation.

2. A hair band as claimed in claim 1 wherein each hairband strip is sewn to the foundation.

3. A hair band as claimed in claim 1 wherein said foundation has an upper edge and a lower edge and an intermediate segment, a first plurality of hairband strips are mounted to said upper edge of said foundation in a first spaced apart pattern, a second plurality of hairband strips are mounted to said foundation in a second spaced apart longitudinally aligned pattern on said intermediate segment of said foundation, and a third plurality of hairband strips are mounted to said lower edge of said foundation in a third spaced apart pattern and wherein respective intermediate spaces of said first, second and third spaced apart patterns are covered by hairs falling there over due to the bricklayered pattern.

4. A hair band adapted to be worn about the head of a user comprising:

an elongated stretchable foundation which is both laterally and longitudinally expandable;

a plurality of no-looped-hair hairband strips attached to said foundation in a bricklayered pattern thereby permitting said hair wefts to move both laterally and longitudinally with the foundation expansion;

each hairband strip having embedded in a glass silk-polyurethane matrix a plurality of substantially parallel hairs with cuticular scales laying in the same direction to avoid cuticular scale interference between adjacent hairs which fall beyond the head of the user wearing the hair band;

a filament attached to said foundation via one or more elastic members, said filament and foundation combination adapted to partly encircle the head of the user in a tension fit; and one or more respective cloth tunnels for part of said one or more elastic elements at one or more respective interfaces between said elastic member and said foundation.

5. A hair band as claimed in claim 4 wherein said foundation has an upper edge and a lower edge and an intermediate segment, a first plurality of hairband strips are attached to said upper edge of said foundation in a first spaced apart pattern, a second plurality of hairband strips are attached to said foundation in a second spaced apart longitudinally aligned pattern on said intermediate segment of said foundation, and a third plurality of hairband strips are attached to said lower edge of said foundation in a third spaced apart pattern and wherein respective intermediate spaces of said first, second and third spaced apart patterns are covered by hairs falling there over due to the brick layered pattern.

* * * * *